United States Patent [19]

Menaged

[11] Patent Number: 5,025,353

[45] Date of Patent: Jun. 18, 1991

[54] ADJUSTABLE READING STAND AND LIGHT ASSEMBLY

[76] Inventor: David L. Menaged, 12260 SW. 40th St., Miami, Fla. 33175

[21] Appl. No.: 492,074

[22] Filed: Mar. 12, 1990

[51] Int. Cl.[5] ..... A47B 19/00

[52] U.S. Cl. ..... 362/98; 362/427; 362/287; 362/430; 248/222.4; 248/453

[58] Field of Search ..... 362/98, 99, 427, 428, 362/287, 430; 248/453, 222.4

[56] References Cited

U.S. PATENT DOCUMENTS

| | | | |
|---|---|---|---|
| 908,751 | 1/1909 | Cooke | 248/222.4 |
| 1,898,666 | 2/1933 | Isaacson | 362/98 |
| 2,707,415 | 5/1955 | Rooney, Jr. | 362/98 |
| 4,432,042 | 2/1984 | Zeller | 362/98 |
| 4,494,177 | 1/1985 | Mathews | 362/427 |
| 4,510,559 | 4/1985 | Kristofek | 362/427 |
| 4,517,632 | 5/1985 | Roos | 362/427 |
| 4,739,960 | 4/1988 | Adler | 248/453 |

*Primary Examiner*—James C. Yeung

*Attorney, Agent, or Firm*—Malloy, Downey & Malloy

[57] ABSTRACT

The present invention relates to a light assembly capable of being used in and of itself and in direct combination with a reading stand of a type structured to support books or any other reading material or a copy on an exposed surface of a copy holder portion thereon and further wherein the various components of the reading stand, as well as the light assembly, are selectively adjustable so as to facilitate placement of the light in an efficient illuminating position relative to a book or copy retained in supporting engagement on the reading stand.

17 Claims, 3 Drawing Sheets

ADJUSTABLE READING STAND AND LIGHT ASSEMBLY

BACKGROUND OF THE INVENTION

1. Field of the Invention

A reading stand or like copy holder and light assembly for use therewith wherein both the reading stand and light assembly are selectively adjustable and removably attached to one another to facilitate placement of the light in a more efficient location relative to a copy or book retained on an exposed surface of the copy holder portion of the reading stand.

Description of the Prior Art

Reading stands and like devices more generically referred to as copy holders are used for a variety of purposes, generally associated with the support and position of various types of copy in a more efficient and exposed position relative to the user of such a stand. The prior art is replete with structures of the type set forth above, some of which include a lighting structure associated therewith and positioned to direct light directly on the surface or face of the copy or book being observed. Typically, stands of the type referred to herein include some type of longitudinally adjustable support arm holding a normally planar copy holder plate or the like at an angled position relative to an observer. The copy, which may include a variety of different objects, including books or magazines, is normally retained on an exposed surface of the copy holder in a preferred orientation for viewing. Other features also exist in the prior art relating to the retaining of the various pages in a preferred position and the support of the copy on the exposed face in such a manner that it can be removed and/or manipulated as by turning individual pages.

U.S. Pat. No(s). showing structures which are representative of prior art devices include 4,819,902; 4,014,508; 3,350,150; 3,200,791; and 2,732,481.

In light of the above structure, there is still a need and demand in this industry for a more efficient supporting reading stand and copy holder structure for the efficient presentation of various objects to be read or observed, while sitting in a comfortable, upright position, wherein a stand may be used in direct combination with a lighting assembly and/or wherein the lighting assembly may have a versatile structure applied thereto so as to allow it to be used independently of the reading stand for the efficient illumination of other areas.

SUMMARY OF THE INVENTION

The present invention relates to a reading stand and also to a lighting assembly which can be used in combination therewith. Alternately, the lighting assembly is capable for independent use with a cooperative light supporting base unassociated with the reading stand per se.

The reading stand of the present invention includes a support assembly including a base having a supporting arm mounted thereon and extending upwardly therefrom. The support is telescopically structured so that its length may be adjusted. An opposite or upper end of the support arm has a copy holder having a substantially planar configuration adjustably mounted thereto and connected so as to be oriented relative to the upper end of the support arm at a variety of angles to accomplish sufficient positioning of books and like copy objects on an outer exposed surface thereof. A support plate is secured to a lower end of the copy holder and extends angularly outward from the exposed surface thereof. A stop plate is also provided adjacent to the support plate. The stop plate is angularly adjustable so as to engage the lower end of books or like objects, thereby ensuring that the pages do not inadvertently turn. A gripping pad or like member made of a somewhat flexible material and including a plurality of protrusions extending outwardly therefrom. The gripping pad is preferably secured to an outer exposed surface of the stop plate. The support plate and stop plate, therefore, serve the purpose of supporting the lower end of a book on the exposed surface of the copy holder while also serving to properly maintain the pages of the book in the intended, opened position. In addition, retaining means in the form of two retaining arms are secured to a general upper end of the copy holder and are exposed in depending, substantially overlapping relation to spaced apart portions of the cover of the book or like object maintained thereon. Such retaining arms are spring biased so as to be movable outwardly from the copy holder to allow positioning or removal of the book or other copy relative to the exposed surface of the copy holder.

The light assembly of the present invention includes a base having a somewhat hollow interior in which is mounted the electrical control and substantially conventional component which serves to power and activate a light source in the form of a light bulb secured within a light housing. A support member having a plurality of innerconnected and adjustably attached segments serve to innerconnect the light housing to the base. The adjustable innerconnection of each of the plurality of segments is such as to allow adjustable selective positioning of the housing relative to the exposed surface of the copy holder and any copy maintained thereon. The base is removably attached to the under surface of the copy holder through the provision of mounting means formed both on the under surface and on the base itself.

An electrical conductor means is removably attached to the base and serves to innerconnect the interior activating electronic control and components to a conventional power source for energizing the light source within the light housing. This same conductor means is usable with a second preferred embodiment of the present invention when the light assembly is used other than in direct combination with the reading stand.

In the second preferred embodiment, a light support includes an exterior housing having a hollow interior which is filled with a weighted material of sufficient density to adequately anchor the light assembly. Supporting innerconnection between the remainder of the light assembly and the light support occurs by the aforementioned base being disposed within an integrally formed socket. This socket extends substantially into the interior of the light support, but in segregated relation to the weighted material on the interior of the housing. The pocket has an opened upper end formed on an uppermost face of the housing and being dimensioned to allow a sliding, removable fit of the base portion of the lighting assembly therein. The aforementioned electrical conductor means, in addition to an elongated external conductor, further includes a male plug integrally or fixedly attached to the base. This male plug is disposed to fit within a female receptacle formed at the bottom, or other applicable location, within the pocket. An electrical conductor segment innerconnects the internal female socket to a male plug formed in the housing so as to communicate with the exterior thereof. The aforementioned external conductor, therefore, is attachable to the exteriorally accessible plug and is further structured to have its opposite end connected to a conventional electrical wall-type socket for powering of the light assembly.

Other features of the subject invention include the light housing in which the light source, in the form of a light bulb, is removably attached therein. A handle means, structured from a non-heat conducive material, is mounted on the exterior of the housing so as to accomplish its manual positioning and arrangement into a desired light illuminating position relative to the material being viewed or read.

Yet another feature associated with the housing is the provision of one of a plurality of plates removably disposed in covering relation to the light source and being formed from a transparent material so as to allow the illumination to pass therethrough. This cover plate is slidingly mounted and supported on a carrier structure mounted immediately adjacent to an open face of the housing over which the cover plate is positioned. The carrier is structured to include a receiving track-like structure in which the transparent material cover plate is slidably positioned. As set forth above, a plurality of such cover plates may be provided wherein one of the cover plates may be formed, at least in part, from a clear transparent material and the remaining cover plates may be formed from transparent material each having a different color. The light eminating onto the copy to be viewed or read will, therefore, be illuminated into different hues or color preferred by the reader or observer.

BRIEF DESCRIPTION OF THE DRAWINGS

For a fuller understanding of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
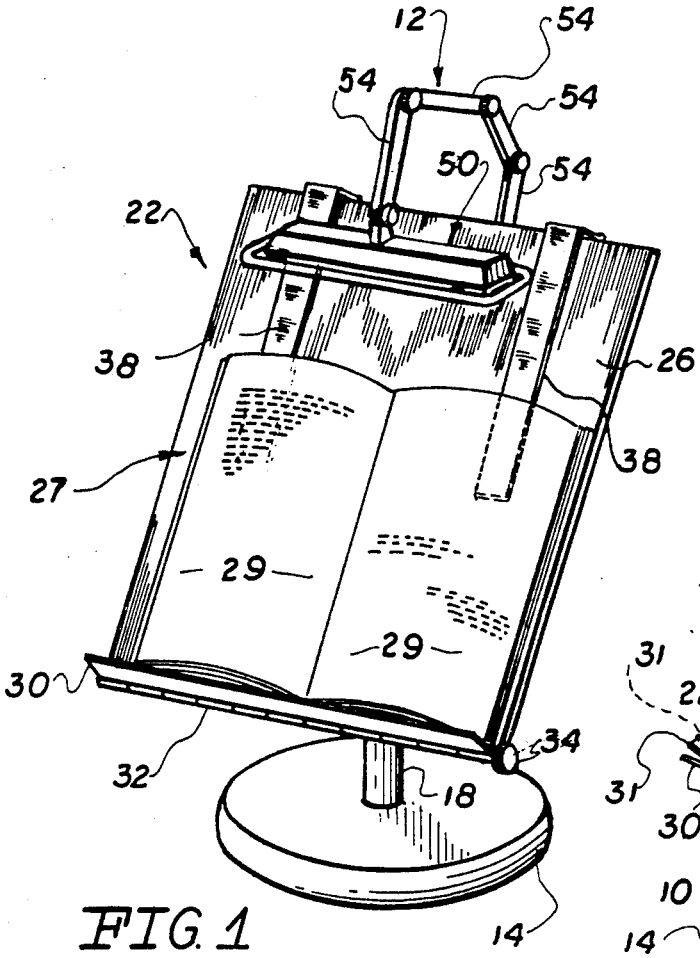
FIG. 1 is a perspective view of one preferred embodiment of the present invention including a reading stand and combined light assembly.
Figure 2:
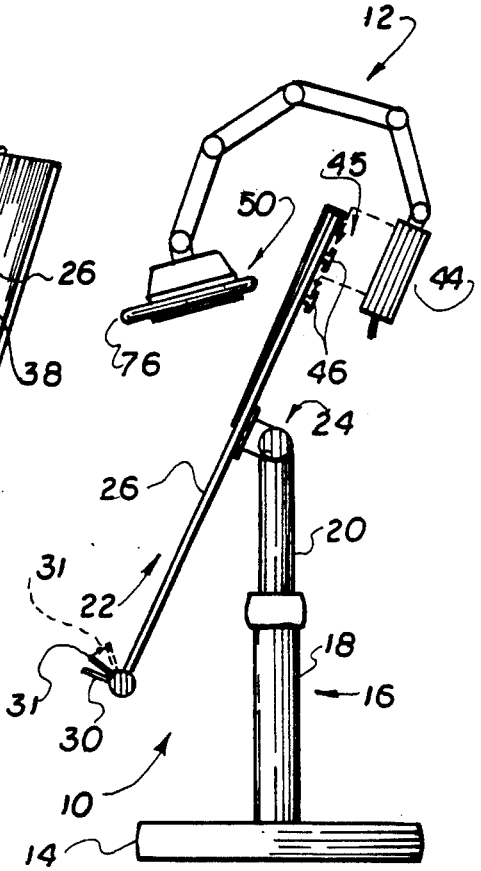
FIG. 2 is a side view of the embodiment of FIG. 1 in at least partially exploded form.
Figure 3:
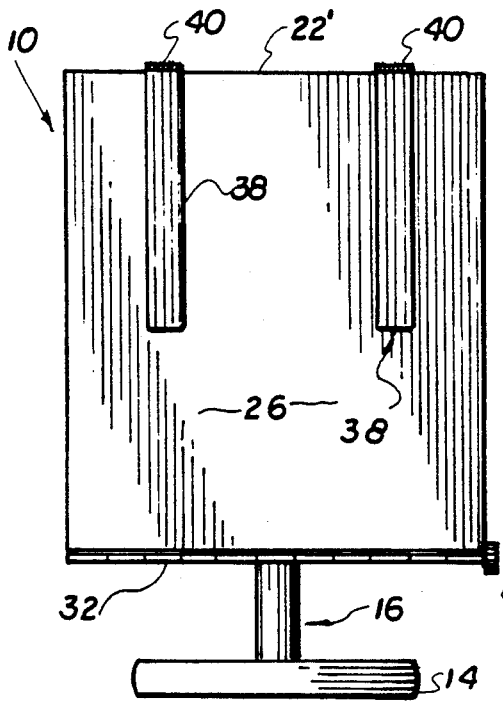
FIG. 3 is a front view of the embodiment of FIG. 1.

As shown in FIGS. 1–4 one preferred embodiment of the present invention comprises a reading stand generally indicated as 10 having a light assembly generally indicated as 12 removably attached thereto. More specifically, the reading stand includes a support platform 14 dimensioned and configured to be positioned on any type of supporting surface such as a desk, table, etc. The stand 14 includes a support arm 16 having telescopically innerconnected segments 18 and 20 which enables the length of the support arm 16 to be varied thereby regulating the height of a copy holder generally indicated as 22. The copy holder 22 is connected at the upper end of the support arm 16 as at 24 in a manner which allows its angular adjustment relative thereto. The copy holder 22 includes an outer exposed surface 26 on which a copy or book 27 may be mounted in a manner shown in FIG. 1. The copy holder further includes a support plate 30 fixedly mounted to the lower end of the copy holder 22 so as to extend angularly outward from the exposed surface 26. As best shown in FIGS. 2 and 5, a stop plate 31 is mounted in an angularly adjustable position between the exposed surface 26 and the support plate 30. Such angular adjustment occurs through the provision of a hinge structure 32 interconnecting the stop plate 31 to the bottom of the copy holder 22. A knob 34 serves to angularly orient and position the support plate 31 so that it may be positioned to engage the lower end of the various pages 29 of the book 27, thereby preventing the pages 29 from inadvertently turning. To facilitate this, a gripping pad or like structure as at 33 is mounted on the stop plate 31. The gripping pad 33 is formed preferably from a flexible material such as rubber or the like and includes a plurality of depending fingers having an enlarged head as at 35 disposed to pass through apertures 37 formed in the stop plate 31. The outer surface of the gripping pad 33 has a plurality of protrusions as at 39 integrally formed therein and positioned to help grip the lower ends of pages 29 of the copy material or book 27 supported on the exposed surface 26 of the copy holder 22. The hinge 32 and manipulating knob 34 may include some type of locking structure to maintain the stop plate 31 in its preferred angular orientation as basically shown in FIG. 2.

Further, retaining means in the form of two retaining arms 38 are connected generally at the upper end 22' of a copy holder 22 and depend downwardly therefrom in overlying, substantially covering relation to spaced apart portions of the exposed surface 26 and against the inside cover of a book or a copy 27 placed thereon. Each of the retaining arms 38 are connected as at 40 by spring biased connectors serving to normally bias the arms 38 into the aforementioned covering relation to the exposed surface 26 and in overlapping covering relation to the inner surfaces of the cover portions or other parts of the book 27. Due to the spring bias connectors 40, each of the arms 38 may be independently moved outwardly from the surface 26 and the copy so as to position or remove the copy as desired.

Figure 4:
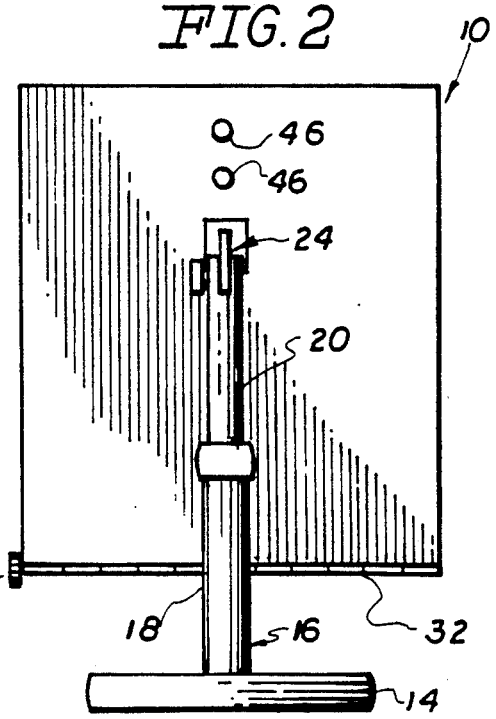
FIG. 4 is a rear view of the embodiment of FIG. 1.
Figure 5:
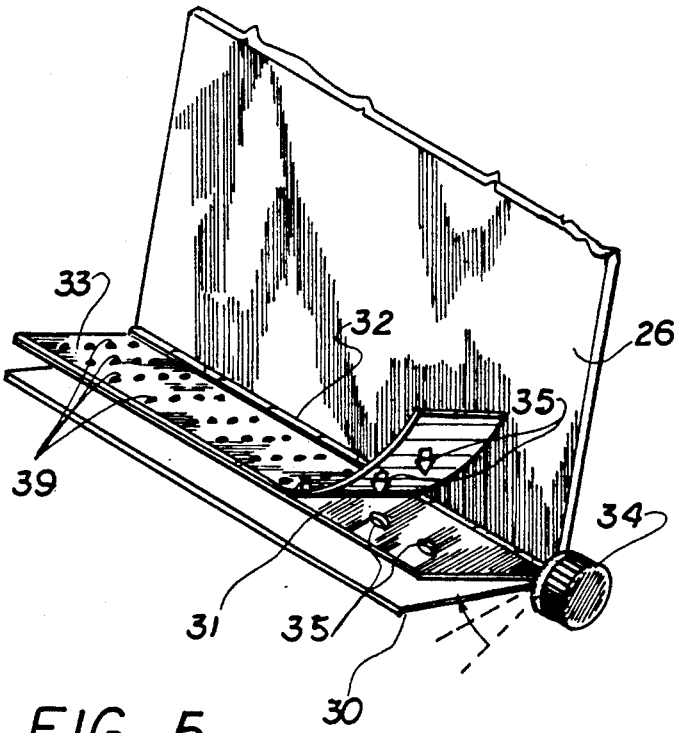
FIG. 5 is a perspective view and partial cutaway of a lower end of a copy holder including the provision of a stop plate and support plate.
Figure 7:
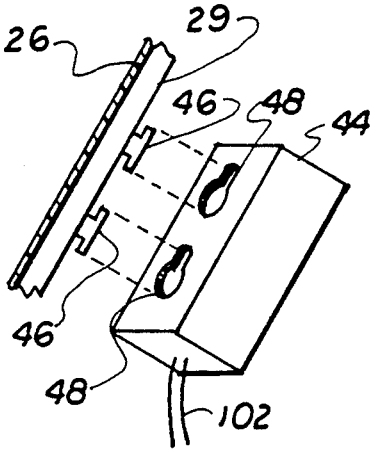
FIG. 7 is a perspective view and partial cutaway in exploded form of attachment structure for the light assembly.

As shown in FIGS. 2, 4, and 7, the light assembly includes a base 44 which is removably attached to the under surface 29 of the copy holder 22 through the provision of mounting means generally indicated as 45 (See FIG. 2). As best shown in FIG. 7, the mounting means comprises two mounting fingers 46 extending outwardly from the under surface 29 and structured to be received within mounting apertures 48 integrally formed in the base 44 and passing at least partially into the interior thereof. The cooperative disposition and configuration of the mounting fingers 46 and the apertures 48 are such as to allow removable insertion of the fingers 46 into the interior base 44 through the apertures 48 as best shown in FIG. 7.

Figure 8:
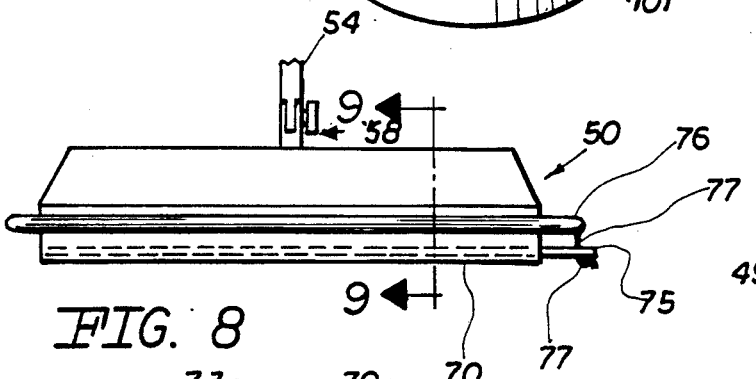
FIG. 8 is a detailed view in partial phantom and cutaway of a light housing associated with the light assembly of the present invention.
Figure 9:
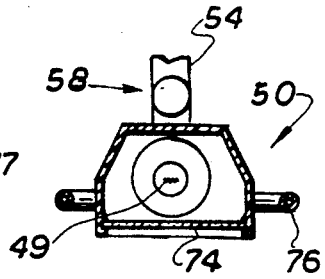
FIG. 9 is a sectional view along line 9—9 of FIG. 8.
Figure 10:
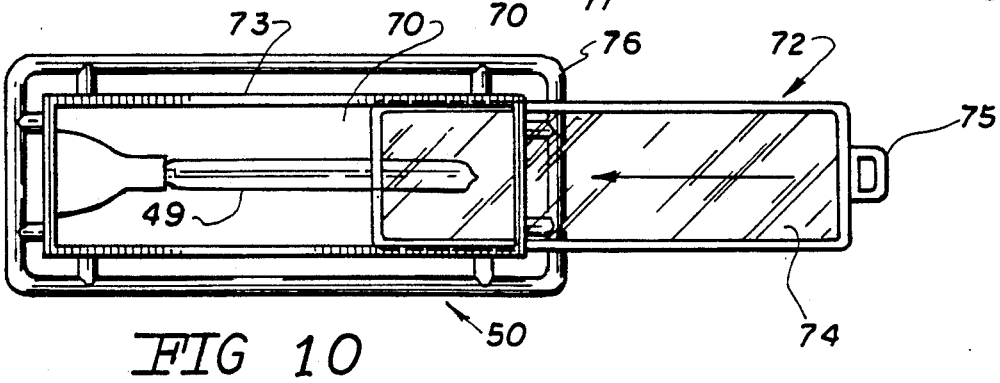
FIG. 10 is a bottom view of the embodiment of FIG. 8.

Other features of the light assembly 12 are shown in detail in FIGS. 8, 9, and 10. The base 44 has a hollow interior portion in which the electronic controls and components 47 are housed which serve to power and otherwise activate the light source in the form of a light bulb 49. The light bulb 49 is, of course, mounted within a light housing generally indicated as 50. A conventional electrical conductor as at 52 passes through a support structure or member comprising a plurality of support segments 54 innerconnecting the base to the light housing 50. Each of the support segments 54 are innerconnected in an articulated manner to one another by a plurality of adjustable attachments generally indicated as 58.

Other features of the light assembly are best shown in FIGS. 8, 9, and 10. As shown therein, the light housing 50 has a hollow interior terminating in an open face as at 70 through which light eminates from a light source in the form of a light bulb 49. A cover assembly including at least one of a plurality of cover plates 72 are each, individually, disposed to be removably supported in such covering position relative to the light bulb 49 by a carrier assembly 73. The carrier assembly comprises a mounting or carrier track along which a cover plate 72 slides into and out of covering position relative to the light bulb 49. Each of a plurality of cover plates 72 are formed in large part from a transparent material such as glass, clear plastic, etc. as at 74. Depending upon the cover plate used, the transparent material 74 may be clear or may be comprised of any one of a plurality of numerous colors. When a colored cover plate is disposed in overlying or covering relation to the light source 49, obviously, the copy or copy holder will force light to be eminated from the housing 50 in that same color or hue. A handle 75 is provided to freely manipulate the cover plate 72 into and out of its covering position. Also, a lock member 77 may be provided to engage the handle and maintain the cover plate 72 in a closed position.

The housing further comprises an adjustable or manipulating handle as at 76 disposed in continuous surrounding relation to the housing 50 and mounted on the exterior part thereof. This handle 76 is formed, at least in part, of non-heat conductive material so as to prevent heat from the light source 49 and housing 50 to be transmitted to the handle 76, thereby protecting the user.

Figure 6:
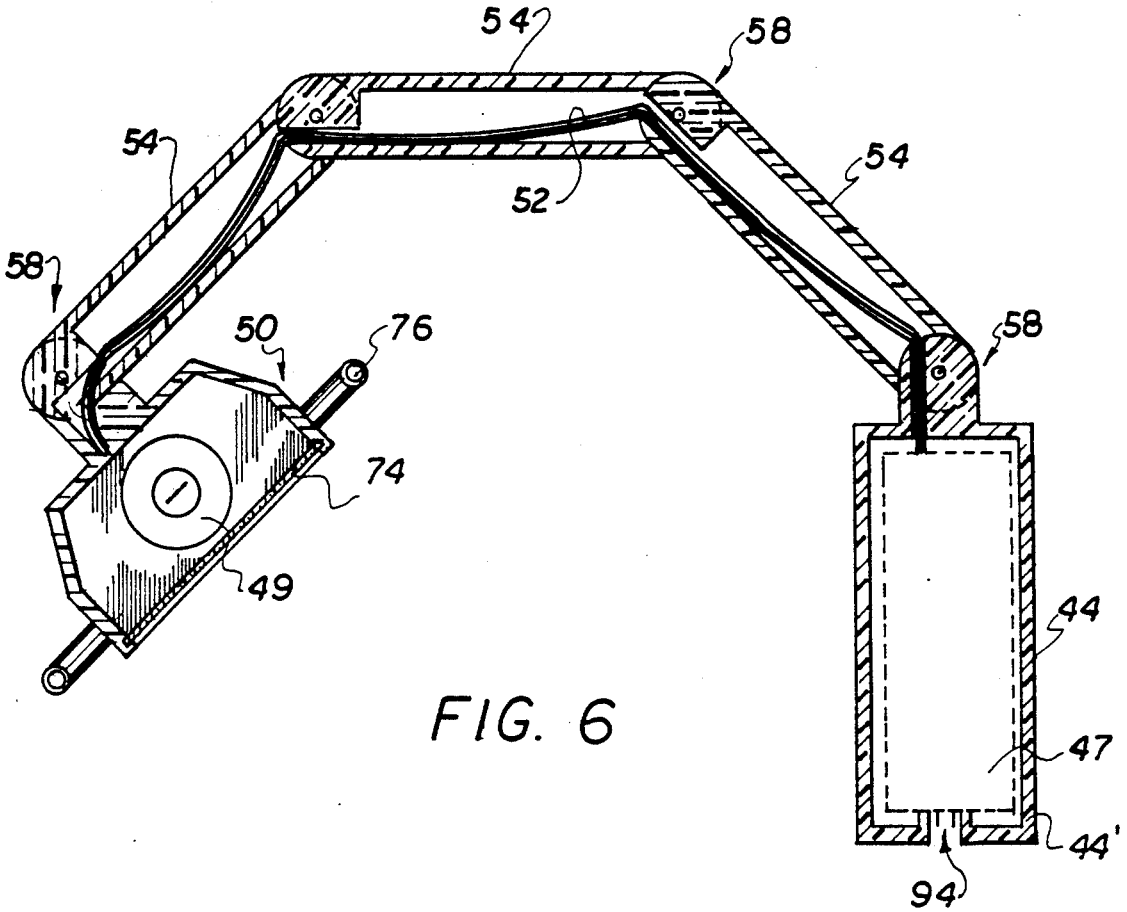
FIG. 6 is a longitudinal sectional view of the light assembly of the present invention as displayed in FIG. 1.
Figure 12:
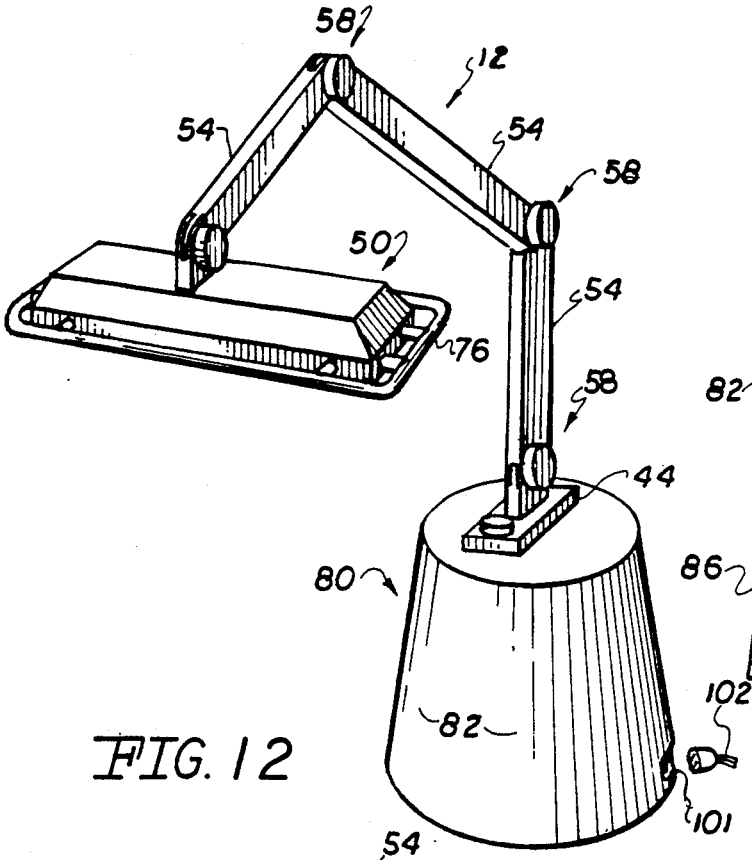
FIG. 12 is a perspective view of the additional preferred embodiment of the present invention.
Figure 11:
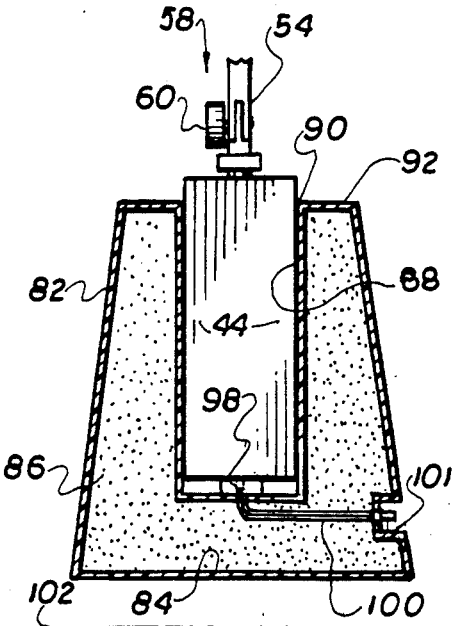
FIG. 11 is a sectional view and partial cutaway of another preferred embodiment of the present invention.

Another embodiment of the present invention is shown in FIGS. 11 and 12. This embodiment comprises a light support generally indicated as 80 including a housing 82 having a somewhat hollow interior 84 which may be filled with a weighted material 86 of sufficient density to provide stability when the remainder of the light assembly 12 is attached thereto and extends outwardly therefrom. The housing 82 includes an integrally formed pocket 88 having an open end as at 90 formed in an uppermost face or surface 92 of the housing. The open end 90 is specifically configured and dimensioned to receive the base 44 of the light assembly 12 therein. As shown in FIG. 6, the base 44 includes a male type connecting plug 94 protruding from a lower most end thereof as at 44'. This male plug 94 is designed to connect with a female plug or like receptacle 98 formed on the interior of the pocket 88. An internal electrical conductor as at 100 serves to innerconnect the interior female socket 98 with an external male plug type connector 101. An external conductor 102 is appropriately structured at one end to fit the male type plug 101 and has its opposite end substantially conventionally structured to fit within a wall socket (not shown). The embodiment of FIG. 11 and 12 may be used independently of the copy holder 22 when it is desired to efficiently position an illuminating source on any other surface for reading copy or the like. Naturally, the embodiment of FIGS. 11 and 12 could also be used with the reading stand as shown in FIGS. 1–4.

Now that the invention has been described,

What is claimed is:

1. A light assembly for use in combination with a reading stand comprising:

said reading stand including a support platform configured for mounting on a supporting surface and a support arm secured thereto and extending upwardly therefrom, said reading stand further including a copy holder having a substantially planar configuration and attached to and adjustably positionable on an outer end of said supporting arm, said copy holder including a support plate mounted on lower end thereof and extending outwardly therefrom into supporting relation to a copy positioned on an outer exposed surface of said copy holder, a stop plate pivotally mounted to said lower end of said copy holder and angularly adjustable relative thereto in retaining position relative to lower ends of the copy disposed on said outer exposed surface, adjustment ;means mounted on said copy holder and movably interconnecting said stop plate to said lower end of said copy holder for adjustable, angular retaining orientation of said stop plate relative to the lower ends of the copy disposed on said outer exposed surface, said light assembly including a base assembly mountable adjacent to said copy holder and structured to house a control means for activating and powering a light associated with said light assembly, mounting means secured at least in part to an under surface of said copy holder and structured to removably support said base of said light assembly thereon, a support member having an end connected to said base and extending outwardly therefrom into supporting attachment with a light housing at an opposite end thereof relative to said base, said support member and said light housing adjustably connected and selectively positionable relative to said outer exposed surface and copy thereon, and a conductor means movably attachable to said base and said control means therein for connection from said control means to a source of electrical power.

2. A light assembly as in claim 1 wherein said support arm is telescopically structured and selectively adjustable along its length, whereby a distance between said support platform and said copy holder is variable.

3. A light assembly as in claim 1 wherein said support plate extends outwardly and is fixedly attached along its length to a length of said lower end of said copy holder.

4. A light assembly as in claim 1 further comprising retaining means secured to an upper end of said copy holder and disposed in depending relation to said exposed surface in substantially overlapping and retaining relation to portions of the copy thereon.

5. A light assembly as in claim 4 wherein said retaining means comprises two spaced apart depending arms connected to an upper end of said copy holder and depending downwardly in adjustable overlapping relation to the copy of said exposed surface.

6. A light assembly as in claim 5 further comprising biasing means attached in interconnection relation between each of said arms and said copy holder and structured to adjustably and independently position each of said arms outwardly from said exposed surface into and out of retaining engagement to different portions of the copy on said copy holder.

7. A light assembly as in claim 1 wherein said mounting means comprises a plurality of fingers secured to and extending outwardly from said under surface and a plurality of receiving apertures formed in said base and cooperatively structured with said fingers to removably attach said base to said under surface.

8. A light assembly as in claim 7 wherein said support member comprises a plurality of articulated segments adjustably relating to one another and collectively to said light housing, said plurality of segments collectively dimensioned and structured to selectively extend and position said light housing from said base to a preferred illuminating position relative to a copy and said exposed surface of said copy holder.

9. A light assembly as in claim 1 wherein said light housing comprises an open face disposed to allow illumination from the light bulb to pass therethrough and connecting means including at least one transparent plate removably mounted in at least partially covering relation to said open face and disposed to allow illumination to pass therethrough.

10. A light assembly as in claim 9 wherein said light housing comprises a carrier structure disposed adjacent said open face and structured to removably support said one plate thereon.

11. A light assembly as in claim 10 wherein said cover means comprises a plurality of plates each formed from a transparent material of a variety of colors.

12. A light assembly as in claim 1 wherein said light housing further comprises an adjustment handle formed of non-heat conducting material secured thereto and spaced outwardly therefrom.

13. A light assembly as in claim 12 wherein said adjustment handle is spaced outwardly from said light housing and is defined by a rail substantially continuously surround said housing.

14. A light assembly as in claim 1 further comprising a support base including a housing having a weighted material formed therein and being of sufficient density to anchor a remainder of said light assembly.

15. A light assembly as in claim 14 wherein said housing includes an open ended pocket dimensioned to receive said base therein, said housing including an interior electrical conductor disposed in connectable engagement with said base when positioned within said pocket and a first externally accessible electrical connector.

16. A light assembly as in claim 15 wherein said base includes a plug member formed thereon and disposed and structured to electrically attach to said first electrical connector.

17. A light assembly as in claim 15 wherein said interior conductor electrically interconnects a second electrical connector located within said pocket with said first electrical connector.

* * * * *